US007596821B2

(12) United States Patent
Pawlowski

(10) Patent No.: US 7,596,821 B2
(45) Date of Patent: Oct. 6, 2009

(54) PORTABLE LIFT SEAT CUSHION ASSOCIATED WITH A HANDBAG

(76) Inventor: Anne M Pawlowski, 7456 W. Rosedale, Chicago, IL (US) 60631

( * ) Notice: Subject to any disclaimer, the term of this patent is extended or adjusted under 35 U.S.C. 154(b) by 0 days.

(21) Appl. No.: 12/016,243

(22) Filed: Jan. 18, 2008

(65) Prior Publication Data

US 2008/0174156 A1 Jul. 24, 2008

Related U.S. Application Data

(60) Provisional application No. 60/885,527, filed on Jan. 18, 2007.

(51) Int. Cl.
*A47C 27/10* (2006.01)

(52) U.S. Cl. ..... 5/655.7; 5/255; 5/653; 267/103; 267/143; 297/DIG. 10

(58) Field of Classification Search ..... 5/653, 5/709, 247, 255, 716; 267/81, 103, 107, 267/142–144; 297/DIG. 10
See application file for complete search history.

(56) References Cited

U.S. PATENT DOCUMENTS 112,695 A * 3/1871 Elam ..... 248/628
2,407,933 A * 9/1946 Neely ..... 5/247
3,184,227 A * 5/1965 Viall, Sr. ..... 267/108
3,393,102 A * 7/1968 Carroll et al. ..... 148/26
4,003,564 A * 1/1977 Taylor ..... 267/108
4,116,310 A * 9/1978 Shields ..... 224/576
4,929,025 A * 5/1990 Lu ..... 297/452.51
5,116,100 A * 5/1992 Iversen ..... 297/313
6,371,641 B1 * 4/2002 Wilson, Jr. ..... 383/4
6,905,169 B1 * 6/2005 Donoghue ..... 297/250.1

* cited by examiner

*Primary Examiner*—Alexander Grosz
(74) *Attorney, Agent, or Firm*—Patents + TMS, P.C.

(57) ABSTRACT

A portable lift cushion to provide aid in lifting a user may include a handle to allow the user to carry the portable lift cushion, a first housing section to house a portion of the portable lift cushion, a second housing section to house personal items of the user, a biasing device to compress within the first housing section when the user sits on the first housing section and expands within the first housing section when the user is no longer sitting on the first housing section. The biasing device may include a flexible support bar, and the flexible support bar may be substantially V shaped. The first housing section may include padding on an exterior surface of the first housing section, and the second housing section may include a sealing device to provide access to the interior of the second housing section. The first housing section may be formed from flexible material, and the flexible support bar may include a spring. The sealing device may include a zipper, and the sealing device may include a hook and loop type fastener.

10 Claims, 2 Drawing Sheets

PORTABLE LIFT SEAT CUSHION ASSOCIATED WITH A HANDBAG

The present invention claims priority under 35 USC section 119 and is based on a provisional application filed on Jan. 18, 2007 with a Ser. No. 60/885,527

FIELD OF THE INVENTION

The present invention relates to a handbag and more particularly to a handbag that can be used as a seating device.

BACKGROUND OF THE INVENTION

Some people, especially the elderly, have a difficult time getting up from a chair, sofa or other seat, and these people may ask others for help in getting out of the chair, sofa or other seat. At times, there is no one to ask for help, and these people will struggle to get out of the chair, sofa or other seat. However, it would be advantageous not to be forced to rely on others for the otherwise simple task of getting out of a chair, sofa or other seat.

SUMMARY

A portable lift cushion to provide aid in lifting a user may include a handle to allow the user to carry the portable lift cushion, a first housing section to house a portion of the portable lift cushion, a second housing section to house personal items of the user, a biasing device to compress the first housing section when the user sits on the first housing section and expands the first housing section when the user is no longer sitting on the first housing section.

The biasing device may include a flexible support bar, and the flexible support bar may be substantially V shaped.

The first housing section may include padding on an exterior surface of the first housing section, and the second housing section may include a sealing device to provide access to the interior of the second housing section.

The first housing section may be formed from flexible material, and the flexible support bar may include a spring.

The sealing device may be, for example, a zipper, a hook and loop type fastener and/or the like.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
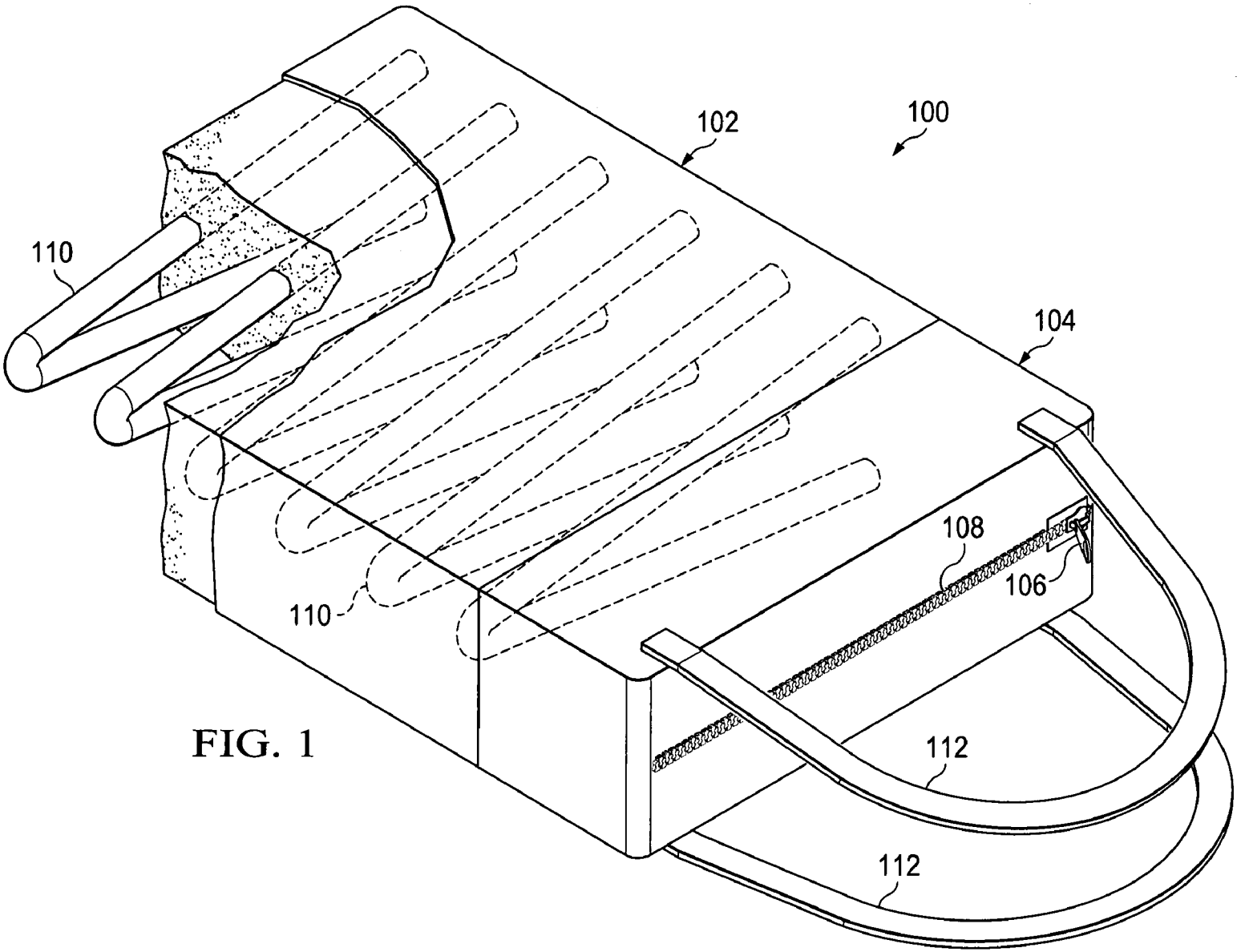
FIG. 1 illustrates a cross-sectional view of the portable lift cushion associated with the handbag of the present invention.

The present invention provides an aid for helping people get up from sitting in a chair, sofa or other seat. Furthermore, the present invention provides a device which is lightweight and portable and can be easily transported. The present invention provides a device that allows for the storage of personal items and provides for handles so that the device can be transported.

This invention is for an apparatus, method and system for a portable lightweight handbag that can be used as a lift seat cushion. The handbag has a handle, a section for the lift seat cushion, and a section for carrying and enclosing other items.

The handbag 100 of the present invention includes a first housing section 102 which is enclosed by a flexible material and should be resilient but moveably flexible lightweight tensile material. It has tensile properties that can expand. The first housing section 102 may be a substantially rectangle shape as shown, a substantially cylinder shape or any other suitable shape. The handbag 100 includes a second housing section 104 which is formed adjacent to the first housing section 102 and handles 112 so that the user can conveniently carry the handbag 100. The second housing section 104 may be a substantially rectangular shape as shown, a substantially cylinder shape or any other suitable shape. The second housing section 104 may include an aperture in the top surface which can be opened and closed so that personal items can be stored within the second housing section 104. A sealing device 106 may be used to open and close the aperture 108 and may be a zipper, a hook and loop type fastener, buttons or other suitable device. The interior of the first housing section 102 includes a biasing device 110 which compresses when the user sits on the first housing section 102 and expands to the original position to aid the user in standing up. The biasing device 110 is shown as a plurality of substantially V shaped flexible support bars 110 which may be integral or affixed together or might also have a spring or spring-like mechanism which expands and lifts. The flexible support bars 110 may be connected together in a spaced relationship to cooperate in lifting the user. The first housing section 102 may include padding on the exterior surface or the interior surface for the comfort of the user. The inside structure should be flexible enough to compress as the person sits on the cushion but resilient enough to give the person lifting assistance as they stand up from the seated position. The lift seat cushion section may additionally be padded for increased sitting comfort. The biasing device 110 may be made of but not limited to rubber rods in bent V shaped structures, rods tensile or non-tensile in V shaped structures with spring like attachments, and or other flexible material with tensile strength, which may be folded or formed in any manner which provides support when the person is sitting down and also seated and lift when standing up. In the case, of a V shaped structure the two opposing ends can compress generally towards each other when the person is sitting down, and provide lift in a direction generally away from themselves, as they decompress when the person stands up.

An additional advantage of the handbag seat is that the handbag may have another section separate from the seating section that can be used to carry items such as a wallet, purse, hairbrush, etc.

Figure 2:
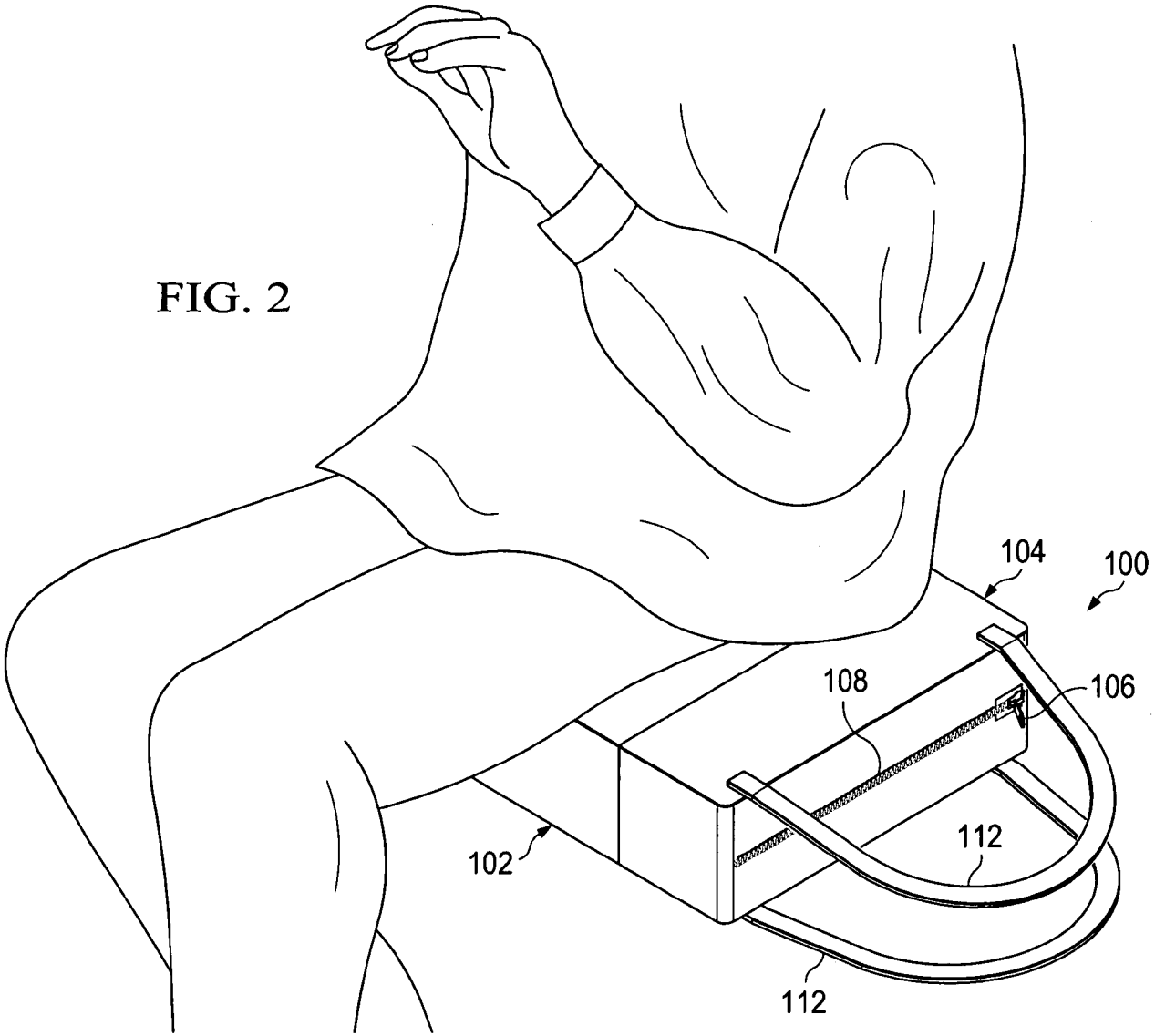
FIG. 2 illustrates a perspective view of a user using the portable lift cushion associated with a handbag of the present invention.

The handbag is portable and can be used on a variety of seating surfaces. The person can place objects in the second housing section 104 of the handbag 100 and may seal them up with a sealing device 106 such as a zipper, a hook and loop type fastener, etc. The person can carry the bag with them and place it on a seating surface with the first housing section 102 placed between the seating surface and the person as shown in FIG. 2. They then sit down with the first housing section 102 and the biasing device 110 compressing while absorbing the person's weight. They then lift themselves from the seat as the biasing device 110 expands or lifts providing additional lifting force to the person.

The advantage of this product is that it is conveniently combined with second housing section 104 which serves as a handbag and is lightweight, portable and is easy to use by simply placing the bag on a seat. It helps control the movement of the person as they sit down while also assisting them as they stand up from the seated position.

The invention claimed is:

1. A portable lift cushion to provide aid in lifting a user from a seated position, to provide a controlled movement of the user down into the seated position and to house personal items of the user wherein the user has a weight, the portable lift cushion comprising:

a first housing section forming a first compartment having a length defined between a first end and a second end wherein the second end is positioned opposite to the first end wherein the first housing section has a width defined between a top side and a bottom side wherein the bottom side is positioned opposite to the top side;

a second housing section forming a second compartment having a length defined between a medial end and a distal end wherein the distal end is positioned opposite to the medial end wherein the medial end is formed adjacent to the second end of the first housing section;

a biasing device within the first compartment wherein the biasing device compresses within and expands within the first compartment with respect to the top side and the bottom side of the first housing section under the weight of the user wherein the biasing device is a plurality of support bars wherein each of the plurality of support bars is substantially V-shaped wherein each of the plurality of support bars is similarly oriented with respect to the top side of the first housing section;

a handle attached to the second housing section; and an aperture in the distal end of the second housing section to access the second compartment.

2. The portable lift cushion of claim 1 wherein the biasing device is constructed from rubber.

3. The portable lift cushion of claim 1 wherein the biasing device compresses within the first compartment with respect to the top side and the bottom side of the first housing section under a first portion of the weight of the user and further wherein the biasing devices expands within the first compartment with respect to the top side and the bottom side of the first housing section under a second portion of the weight of the user wherein the second portion is less than the first portion.

4. The portable lift cushion of claim 1, further comprising: padding on the top side of the first housing section.

5. The portable lift cushion of claim 1, further comprising: a sealing device on the distal end of the second housing to close the aperture.

6. The portable lift cushion of claim 1 wherein the first housing section is constructed from a flexible material.

7. The portable lift cushion of claim 1 wherein each of the plurality of support bars provides a spring-like mechanism.

8. The portable lift cushion of claim of claim 5 wherein the sealing device is a zipper.

9. The portable lift cushion of claim 5 wherein the sealing device is a hook and loop type fastener.

10. The portable lift cushion of claim 1 wherein the first housing section is sized to receive the user in the seated position without deforming the second housing section.

* * * * *